United States Patent [19]

Provan

[11] Patent Number: 4,487,388

[45] Date of Patent: Dec. 11, 1984

[54] HOLDER FOR FACILITATING LOADING OF PLASTIC BAGS

[75] Inventor: Alexander R. Provan, Canandaigua, N.Y.

[73] Assignee: Mobil Oil Corporation, New York, N.Y.

[21] Appl. No.: 488,516

[22] Filed: Apr. 25, 1983

[51] Int. Cl.[3] ..... B65B 67/04

[52] U.S. Cl. ..... 248/97; 248/99; 211/50

[58] Field of Search ..... 248/95, 97, 99, 98, 248/96, 100, 101; 150/49, 51; 211/50; 141/391

[56] References Cited

U.S. PATENT DOCUMENTS

| | | | |
|---|---|---|---|
| 447,686 | 3/1891 | Holladay | 248/100 |
| 868,504 | 10/1907 | Taylor | 248/100 |
| 4,062,170 | 12/1977 | Orem | 53/390 |
| 4,332,361 | 6/1982 | McClellan | 248/99 |
| 4,407,474 | 10/1983 | Swenson | 248/97 |

FOREIGN PATENT DOCUMENTS

| | | | |
|---|---|---|---|
| 1133667 | 7/1962 | Fed. Rep. of Germany | 248/100 |

*Primary Examiner*—Ramon S. Britts
*Assistant Examiner*—Robert A. Olson
*Attorney, Agent, or Firm*—Alexander J. McKillop; Michael G. Gilman; Charles J. Speciale

[57] ABSTRACT

A holder for facilitating loading of articles in a plastic bag removed from a stack of bags, each of the bags having an open mouth and upwardly extendable handle loops, the loops are placed on spaced tabs, the bag is loaded, and the loaded bag is removed from the holder by lifting the loops from the tabs. The holder avoids the use of welds where the holder is subjected to twisting or rocking forces. Specifically, eye form joints are provided to permit some flexing of the rack under stress when the bags are being loaded in the holder.

10 Claims, 6 Drawing Figures

HOLDER FOR FACILITATING LOADING OF PLASTIC BAGS

BACKGROUND OF THE INVENTION

1. Field of the Invention

The present invention relates to a holder for loading of bags. More particularly, the invention relates to a holder for facilitating loading of plastic bags having upwardly extending handle loops, such as bags used to package groceries.

2. Discussion of the Prior Art

A traditional and long-accepted method for packaging merchandise, such as groceries at the check-out counters of grocery stores, has involved the loading of individual paper bags, a process which is oftentimes inefficient, time-consuming and expensive. The person doing the bagging retrieves a bag from a stack, often under a counter, normally opens it by a quick motion of the arm causing air to catch in the bag and distend it, and then sets the bag upright on the counter. In the case of double bagging operations, a second bag must be opened in the same manner and then inserted inside the first bag to provide extra strength. The merchandise, e.g., groceries, is then placed into the open bag and the filled bags are slid across the counter so that the customers can put their arms around the middle of the bags and carry them out. Often, moisture absorption from the products contained within the heavily ladened bags will weaken the bottoms thereof, tending to cause them to separate or tear.

The general concept of packaging items in plastic bags is well known. However, thin plastic bags are very limp in nature and this characteristic not only adversely effects the loading operation, but any attempt to carry such a bag, loaded with groceries, at the mid-portion thereof proves to be very awkward because of the limp film's tendency to allow the upper portion of the bag to fold over, usually with disastrous consequences.

Recent attempts to remedy these deficiencies of plastic bags have included the provision on the bag of handles adjacent to the mouth of the bag. This has helped to alleviate the carrying problem, but the loading operation raised a problem because of the difficulties attendants have in loading a limp plastic bag which is not self-supporting. Elaborate devices have been used to open and support the empty bags, such as blowers which fill the bag with air and vacuum systems which hold the walls of the bag apart and upright, but these can be expensive, require substantial redesign and modification of check-out counters and are subject to mechanical breakdown in heavy use. Although semi-rigid plastic films, such as vinyl, high density polyethylene and high modulus laminar structures formed therefrom, are available and could be used to construct bags which are self-supporting, the cost of such material is far beyond the relative costs of paper packaging materials and therefore, although a potential solution, it is one which is economically unattractive.

U.S. Pat. No. 4,062,170 provides an effective holder for loading plastic bags having handle loops. In this patent, a user removes the topmost bag from a stack of bags supported at the rear of the holder, places each of the handle loops of the bag on a respective one of spaced arm portion tabs, loads the bag, and removes the loaded bag from the holder by lifting the handle loops from the tabs.

Wire rack versions of the holder of U.S. Pat. No. 4,062,170 have been commercialized. These wire racks generally had the wire components welded together. Such wire racks were subject to failure at weld points where twisting or rocking forces occurred due to flexing of the rack under stress during loading of bags.

SUMMARY OF THE INVENTION

The present invention provides a holder having a wire body which will permit flexing of the holder under stress during loading. The design of the holder avoids the use of welds where the holder is subject to twisting or rocking forces.

In accordance with the present invention there is provided a holder for facilitating loading of articles in a plastic bag removed from a stack of bags. Each of the bags has an open mouth and integral upwardly extendable handle loops disposed on opposite sides of the mouth. The holder comprises a pair of spaced mirror-imaged side members, each being formed with a continuous wire bent to provide a vertical rear portion, an arm portion extending forwardly from the upper end of the rear portion, and a base portion extending forwardly from the lower end of the rear portion. The arm portion is formed into an upwardly extending horizontally elongated tab with a rearwardly projecting protrusion, a forwardly extending nose and a downwardly and rearwardly extending first support terminating at one end of the wire. The one end of the wire is crimped about the rear portion. The base portion is formed into horizontally extending parallel rails with a second support extending upwardly from the rear end of the upper one of the rails. The second support terminates at the other end of the wire. The other end of the wire is crimped about the first support.

The holder further comprises a brace member formed from another continuous wire bent to provide a side-to-side stiffening portion interconnecting the lower ends of the vertical rear portions of the side members, and a pair of mirror-imaged load absorbing portions. Each of the load absorbing portions terminates at a respective end of the wire, and is connected to the bottom of a respective one of the second supports. The holder additionally comprises means interconnecting the vertical rear portions at the upper ends thereof for holding the stack of bags, and means interconnecting each of the lower one of the rails for providing a horizontal support surface.

With the holder of the present invention, a user removes the topmost bag from the stack of bags, places each of the handle loops of the bag on a respective one of the arm portion tabs, loads the bag, and removes the loaded bag from the holder by lifting the handle loops from the tabs.

DESCRIPTION OF SPECIFIC EMBODIMENTS

Figure 1:
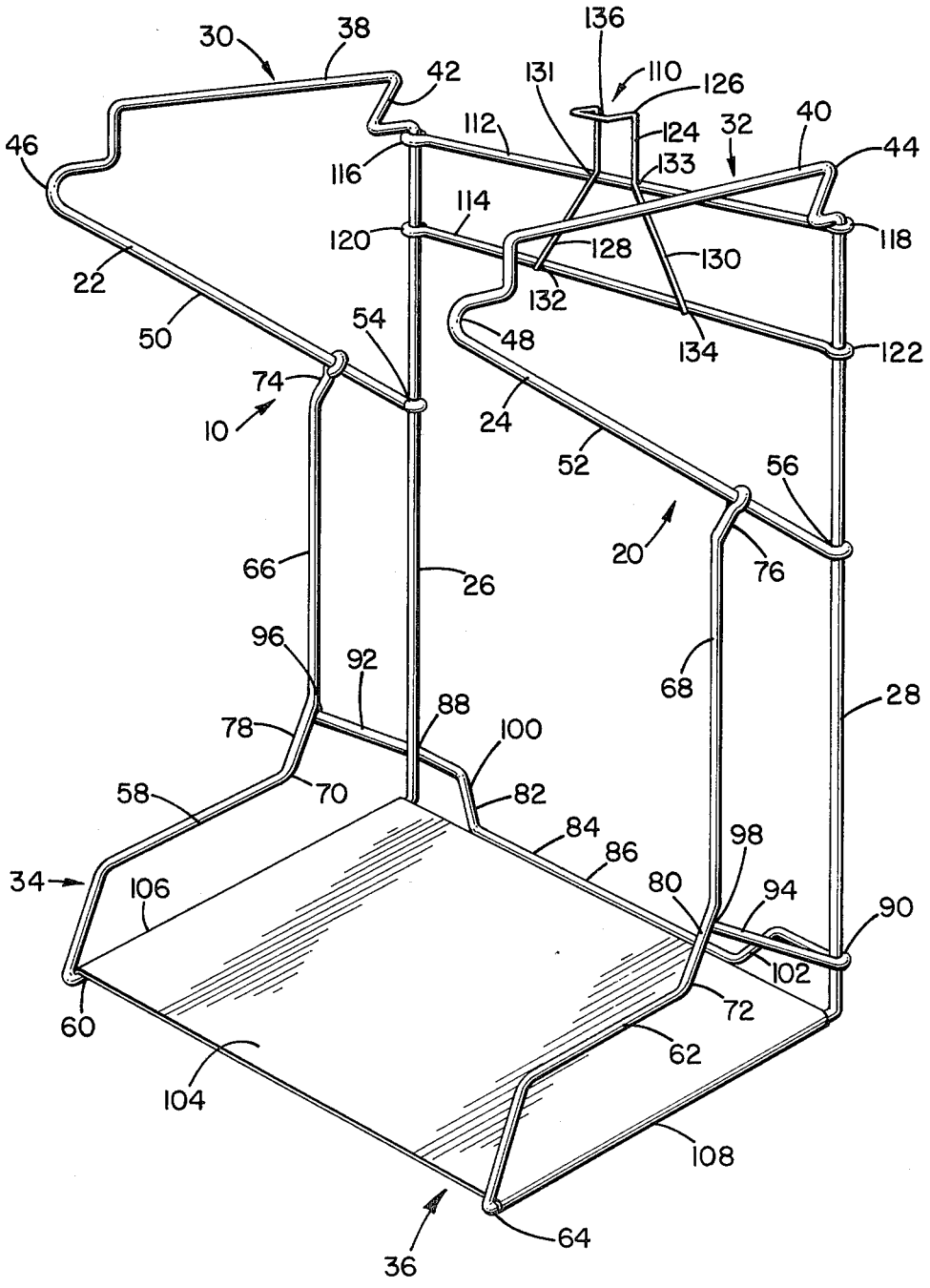
FIG. 1 is a perspective view of a holder embodiment for relatively tall bags in accordance with the present invention.
Figure 2:
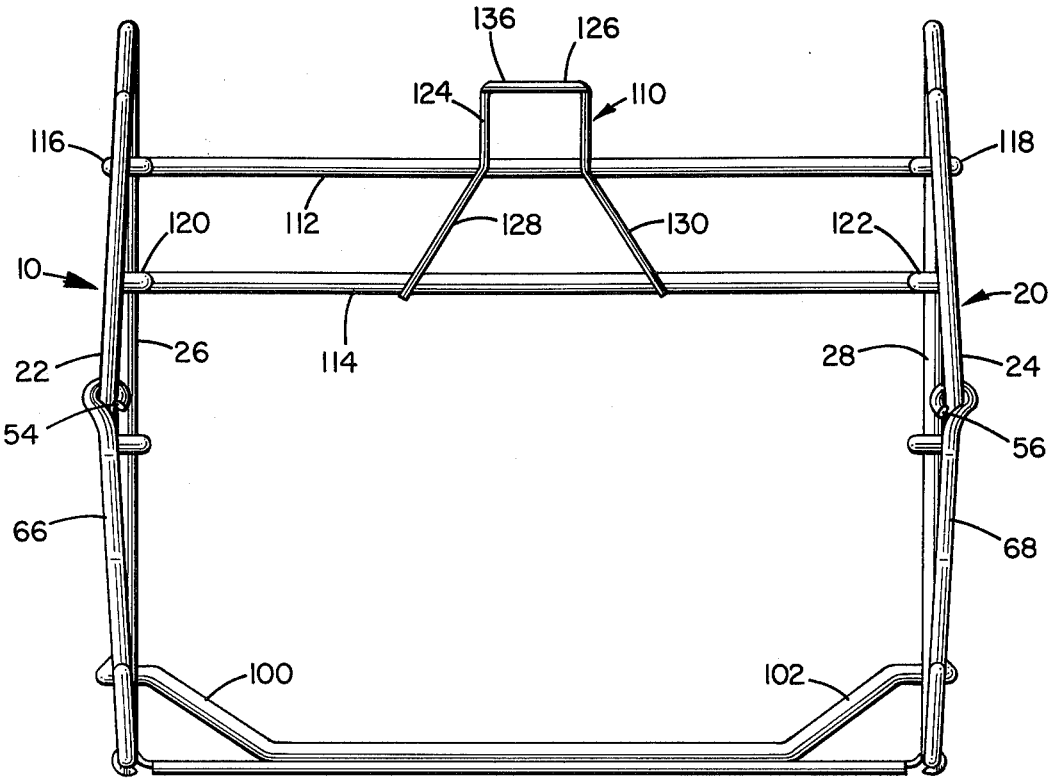
FIG. 2 is a front elevational view of another embodiment of a holder for shorter bags.
Figure 3:
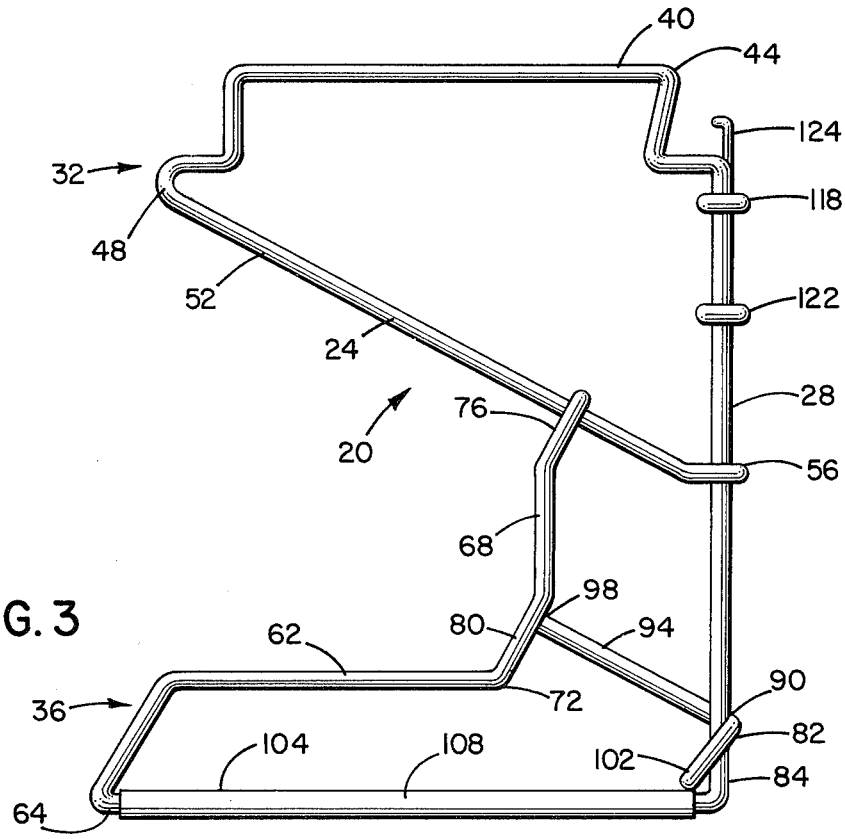
FIG. 3 is a side elevational view of the embodiment of FIG. 2.
Figure 4:
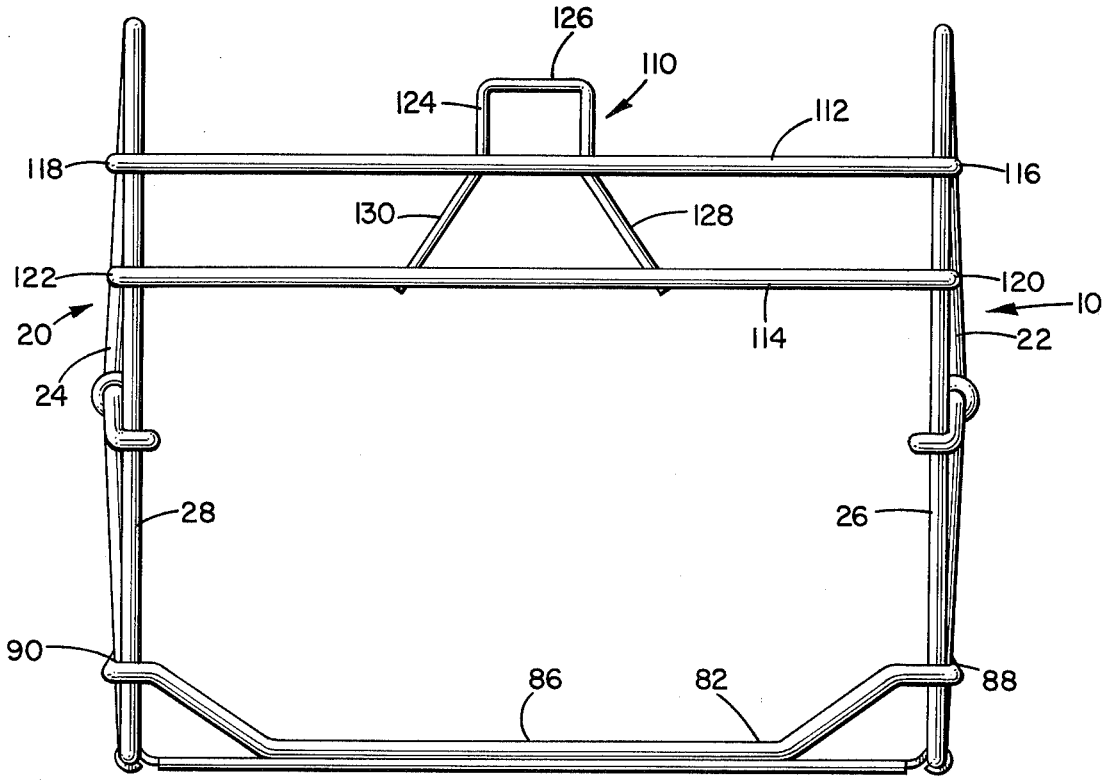
FIG. 4 is a rear elevational view of the embodiment of FIG. 2.
Figure 5:
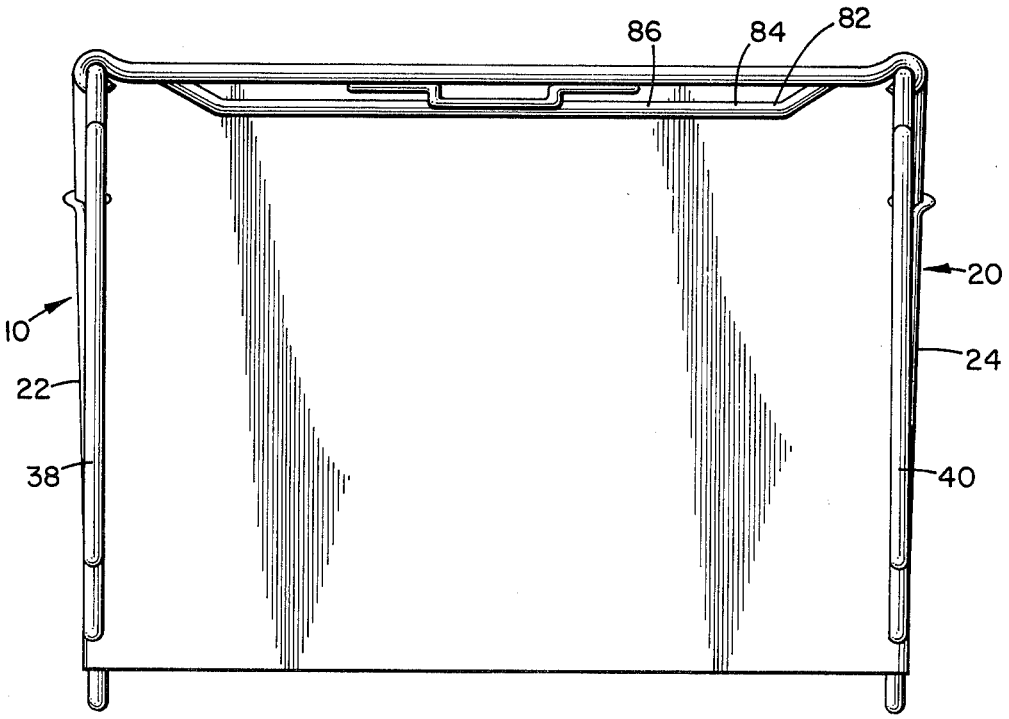
FIG. 5 is a top plan view of the embodiment of FIG. 2.

With reference to FIGS. 1–5, one form of the structure in accordance with the present invention provides a holder having a pair of spaced mirror-imaged side members 10, 20, each being formed with a single continuous wire 22, 24 bent to provide a vertical rear portion 26, 28, an arm portion 30, 32 extending forwardly from the upper end of the rear portion 26, 28, and a base portion 34, 36 extending forwardly from the lower end of the rear portion 26, 28.

The arm portion 30, 32, of each of the side members 10, 20 is formed into an upwardly extending horizontally elongated tab 38, 40 with a rearwardly projecting protrusion 42, 44, a forwardly extending nose 46, 48 and a downwardly and rearwardly extending first support 50, 52 which is bent to approach the vertical rear portions 26, 28 at a right angle, and terminates at one end 54, 56 of the wire 22, 24. The one end 54, 56 of the wire 22, 24 is crimped about the rear portion 26, 28 in a standard centered eye wire form.

The base portion 34, 36 of each one of the side members 10, 20 is formed into horizontally extending parallel rails 58, 60; 62, 64 with a second support 66, 68 extending upwardly from the rear end 70, 72 of the upper rails 58, 62. Each one of the second supports 66, 68 are bent at its upper end 74, 76 to approach the respective first support 50, 52 at a 90° angle. The lower end 78, 80 of each of the second supports 66, 68 is also bent downwardly and forwardly to provide a support surface for a brace member 82.

The brace member 82 is formed from a continuous wire 84 which is bent to provide a side-to-side stiffening portion 86 by welding at 88, 90 to the lower ends of the vertical rear portions 26, 28 of the side members 10, 20.

The brace member 82 also includes a pair of mirror-imaged load absorbing portions 92, 94 extending upwardly and forwardly for a perpendicular connection by welding at the ends 96, 98 to the support surfaces 78, 80 at the lower ends of the second supports 66, 68. Downwardly and forwardly extending portions 100, 102 interconnect the load absorbing portions 92, 94 and the side-to-side stiffening portion 86 of the brace member 82. Means in the form of a sheet metal shelf 104 interconnects the lower rails 60, 64 to provide a horizontal support surface for a bag. The outer ends 106, 108 of the shelf 104 are crimped about the lower rails 60, 64.

Figure 6:
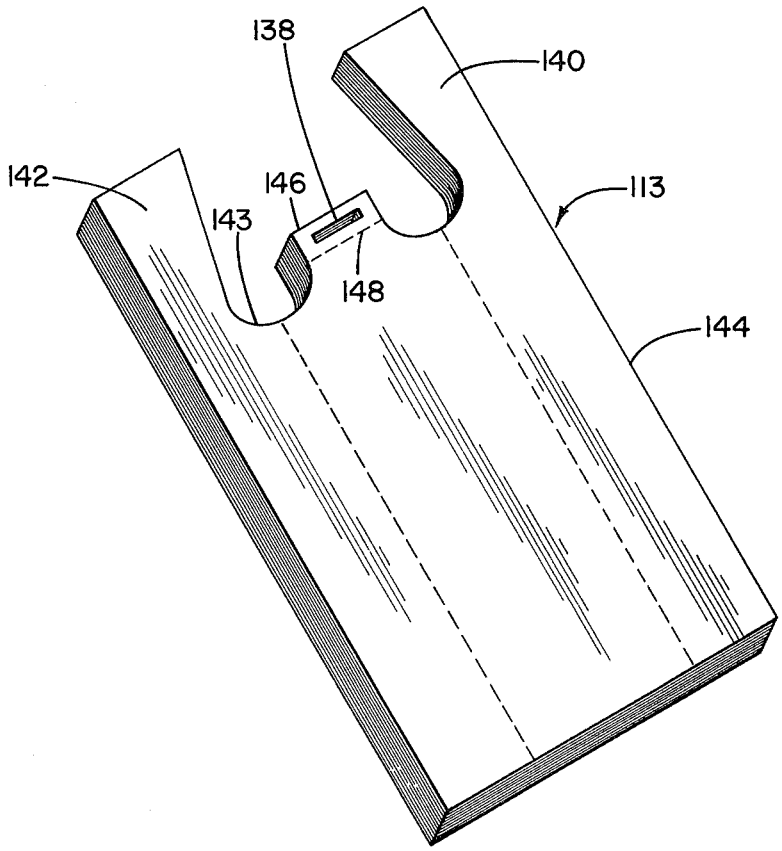
FIG. 6 shows one form of a stack of plastic bags which are loadable with articles by the holder of the present invention.

Means 110 interconnect the vertical rear portion 26, 28 at the upper ends thereof for holding a stack of bags 113 such as shown in FIG. 6.

The stack of bags holding means 110 is formed from a pair of vertically spaced parallel wires 112, 114 each having their respective outer ends 116, 118; 120, 122 crimped about the vertical rear portions 26, 28 of the side members 10, 20. Another wire 124 is bent to provide a loop 126 extending upwardly from the top wire 112 and a pair of trusses 128, 130 extending downwardly and outwardly from the top wire 112 to the bottom wire 114. The wire 124 is welded at points 131, 132, 133, 134 to the top and bottom wires 112, 114 to fix the relative position of the wires 112, 114 and thereby avoid lateral rocking of the holder. The top end of the loop 126 has a forwardly protruding portion 136 for insertion into the aperture 138 of the stack of bags 113 as shown in FIG. 6 to thereby support the stack 113 in the holder with the handle loops 140, 142 on opposite sides of the bag mouths 143 folded over the top wire 112.

The stack of bags 113 shown in FIG. 6 is disclosed in U.S. Pat. No. 4,165,832, which patent is incorporated herein by reference. The bags 144 of the stack 113 each have a detachable tab member 146 attached to the bag 144 by horizontal perforations 148 formed during manufacture. The bags 144 are bonded together during manufacture by using a heated blade element (not shown) which is heated to a temperature to cause penetration of the blade through the tabs 146 to form the apertures 138 and also fuse the peripheral areas of the apertures 138 to bond the bags 144 together into the stack 113.

A user removes the topmost bag 144 from the stack of bags 113 and places each of the handle loops 140, 142 on a respective one of the arm portion tabs 38, 40 with the bottom 150 of the bag resting on the shelf 104. The user then loads the bag and removes the loaded bag from the holder by lifting the handle loops 140, 142 from the tabs 38, 40.

Thus, the present invention provides a holder having a wire body which avoids the use of welds where the holder is subject to twisting or rocking forces. Specifically, eye form joints are provided at the interconnection of the second supports 66, 68 with the first supports 50, 52; at the interconnection of the first supports of 50, 52 with the vertical rear portions 26, 28; and at the interconnections of the pair of parallel wires 112, 114 with the vertical rear portions 26, 28. These eye form joints permit some flexing of the rack under stress when bags 144 are being loaded in the holder, but are not subject to possible failure, as with a welded joint, under continued flexing.

The horizontally extending parallel rails 58, 60; 62, 64 of the base portions 34, 36 limit the bottom width of the bag as it is being packed. Thus, minimizing the possibility that the bottom bag is biased out during packing, which might result in the bottom of the bag tearing.

The brace member 82, as discussed hereinabove, stiffens the holder from side-to-side, and absorbs vertical loading applied to the elongated tabs 38, 40. The shelf 104 may be perforated to bolt the holder to any suitable support. A center bolt fastening through the shelf 104 permits the holder to be pivoted in any direction for packing.

The wires used in the holder of the present invention may be suitably formed of 9GA steel wire, and the shelf 104 may be formed of 16GA sheet steel. The shelf 104 may also have a rolled front edge to avoid the possibility of burrs.

What is claimed is:

1. A holder for facilitating loading of articles in a plastic bag removed from a stack of bags, each one of said bags having an open mouth and integral upwardly extendable handle loops disposed on opposite sides of said mouth, said holder comprising:

a pair of spaced mirror-imaged side members, each of said side members being formed with a continuous wire bent to provide a vertical rear portion, an arm portion extending forwardly form the upper end of said rear portion, and a base portion extending forwardly from the lower end of said rear portion, said arm portion being formed into an upwardly extending horizontally elongated tab with a rearwardly projecting protrusion, a forwardly extending nose and a downwardly and rearwardly extending first support terminating at one end of said wire, said one end being crimped about said rear portion, said base portion being formed into horizontally extending parallel rails comprising an upper rail and a lower rail with a second support extending upwardly from the rear end of the upper one of said rails, said second support terminating at the other end of said wire, said other end being crimped about said first support, a brace member formed from another continuous wire bent to provide a side-to-side stiffening portion interconnecting the lower ends of the vertical rear portions of said side members, and a pair of mirror-imaged load absorbing portions, each one of said load absorbing portions terminating at a respective end of said another wire, each end of said another wire being connected to the bottom of a respective one of the second supports, holding means interconnecting said vertical rear portions at the upper ends thereof for holding said stack of bags, and means interconnecting each of the lower one of said rails for providing a horizontal support surface, whereby a user removes the topmost bag from said stack of bags, places each of said handle loops of the bag on a respective one of the arm portion tabs, loads the bag, and removes the loaded bag from said holder by lifting said handle loops from the tabs.

2. The holder of claim 1 wherein the second supports of said base portions are each bent at respective upper ends to perpendicularly connect to the first supports.

3. The holder of claim 1 wherein the second supports of said base portions are each bent at respective lower ends to provide surface for a perpendicular connection with the load absorbing portions of said brace member.

4. The holder of claim 3 wherein the load absorbing portions of said brace members are welded to the second supports.

5. The holder of claim 4 wherein said side-to-side stiffening portion is welded to the lower ends of the vertical rear portions of said side members.

6. The holder of claim 1 wherein the first supports of said arm portions are each bent at respective rearward ends to perpendicularly connect to the rear portions.

7. The holder of claim 1 wherein said holding means comprises a pair of vertically spaced parallel wires each having outer ends crimped about the vertical rear portions of said side members, and another wire bent to provide a loop extending upwardly from the top one of said pair of wires and to provide a pair of trusses interconnecting said pair of wires, whereby said stack of bags is held by said loop.

8. The holder of claim 7 wherein each one of said trusses extends downwardly and outwardly from the top one to the bottom one of said pair of wires.

9. The holder of claim 7 wherein said trusses are welded to said pair of wires.

10. The holder of claim 1 wherein said support surface providing means is a shelf having the outer ends thereof crimped about the lower ones of said rails.

* * * * *